US006123886A

United States Patent [19]

Slack

[11] Patent Number: 6,123,886

[45] Date of Patent: Sep. 26, 2000

[54] METHOD AND APPARATUS FOR PRODUCING CRIMPED THERMOPLASTICS

[75] Inventor: Philip Trevor Slack, Bradford, United Kingdom

[73] Assignee: SCS Consultancy Services, West Yorkshire, United Kingdom

[21] Appl. No.: 09/051,614

[22] PCT Filed: Oct. 9, 1996

[86] PCT No.: PCT/GB96/02512

§ 371 Date: Aug. 31, 1998

§ 102(e) Date: Aug. 31, 1998

[87] PCT Pub. No.: WO97/13898

PCT Pub. Date: Apr. 17, 1997

[30] Foreign Application Priority Data

Oct. 13, 1995 [GB] United Kingdom ..... 9521040

[51] Int. Cl.[7] ..... D01D 5/22; D01D 5/253; D02G 1/00

[52] U.S. Cl. ..... 264/168; 264/177.13; 264/211.14; 264/211.17; 425/464

[58] Field of Search ..... 264/168, 117.13, 264/211.14, 211.17; 425/464

[56] References Cited

U.S. PATENT DOCUMENTS 3,781,949 1/1974 Breen et al. ..... 264/290.5 X

FOREIGN PATENT DOCUMENTS 1 219 165 6/1966 Germany .
1 126 552 9/1968 United Kingdom .
WO 95/14799 6/1995 WIPO .

OTHER PUBLICATIONS

Abstract of Japan 47–24963 B (1972).

*Primary Examiner*—Leo B. Tentoni
*Attorney, Agent, or Firm*—Rohm & Monsanto, P.L.C.

[57] ABSTRACT

A method for producing a substantial helical crimp in a continuous filament of thermoplastic material by generating a turbulence in the thermoplastic material while the material is in its glass transition phase and maintaining stresses induced in the formed filament by said turbulence while the material passes into its crystallized phase.

21 Claims, 2 Drawing Sheets

METHOD AND APPARATUS FOR PRODUCING CRIMPED THERMOPLASTICS

BACKGROUND OF THE INVENTION

1. Field of the Invention

This invention relates to the production of crimped filaments made from long chain molecule thermoplastics materials and relates particularly, but not exclusively to fibres made from polypropylene.

2. Description of Related Art

Filaments made from long chain molecule thermoplastics materials are well known in the art and are generally extruded through holes in a spinneret plate from a body of the molten plastics material above the spinneret plate. When produced in this manner, the filaments are essentially straight and without crimp. Whilst continuous straight filaments, without crimp, can be used for a number of commercial processes, a crimping of the filament is highly desirable for a number of commercial applications, in particular in the clothing or woven material industries.

One known method for applying a crimp to a continuous filament is to pass the filament, in heated conditions, between a pair of meshing gear wheels but the crimp obtained by the gear wheels is very limited and lies in only one plane of the filament. If the filament is rotated about its axis whilst passing through the gear wheels a helical crimp can be produced but said crimp will require the additional expense of providing a means of rotating each filament and the crimp is relatively weak.

In another known method for crimping filaments the filaments, whilst in heated condition, are cooled on one side and, as the filaments cool, differential stresses will be induced across the diameter of the filaments. When the drawing tension is released from such filaments a wavy, or helical, crimp will develop but, in practise, the degree of crimp applied to and retained by such filaments is relatively small.

SUMMARY OF THE INVENTION

Preferred embodiments of the present invention seek to provide a method for making filaments wherein the filaments have a substantial, generally helical crimp therein.

According to the present invention there is provided a method for producing a substantial helical crimp in a continuous filament, the method comprising the steps of generating a turbulence in a thermoplastic material intended to form the filament whilst the thermoplastics material is in its glass transition phase and maintaining stresses induced in the formed filament by said turbulence whilst the filament material passes into its crystallised phase.

Viewed from another direction the present invention provides a method for inducing a substantial helical crimp in a continuous filament of a thermoplastics material comprising the steps of inducing turbulence in the polymer flow immediately prior to, or at the point of, formation of the filament.

Preferably the turbulence is concentrated towards one side of the cross-section of the filament.

In a preferred embodiment, the molten filaments are rapidly cooled to solidification so that the disturbance of the molecular structure is locked into the crystallised polymer.

During subsequent processing of the filaments when the axial tension is removed from the filaments, the stresses induced into the filaments before or on leaving the spinneret plate cause uneven tensions in the filaments to be relieved which results in distortion of the filaments and produces a pronounced helical crimp effect in each filament.

In a preferred embodiment, the method further comprises the step of extruding the filaments through holes in a spinneret plate wherein each hole makes an angle, preferably an angle of substantially 45°, to an external face of the spinneret plate.

Alternatively, or in addition, the turbulence in the molten plastics may be generated by a change of the cross-sectional area of each hole through the spinneret plate.

In a preferred embodiment the change of cross-sectional area of each hole through the spinneret plate is in the form of a step.

In one embodiment the hole through the spinneret plate from which the filament is drawn is of different cross-sectional areas, with the smallest cross-sectional area at that end of the hole from which the filament is drawn.

In a further embodiment each said filament has a non-circular cross-sectional area and preferably the filament has a cross-sectional shape which is the result of extruding through a hole shape generally equivalent to a full circular cross-section with substantially one quarter of the circle removed.

Preferably the non-circular cross-sectional area of each filament is induced by the cross-section of a hole in a spinneret.

BRIEF DESCRIPTION OF THE DRAWINGS

The present invention will now be described further by way of example only, and not in any limitative sense, with reference to the accompanying drawings in which.

DETAILED DESCRIPTION OF THE INVENTION

In all the examples illustrated a spinneret plate 11 supports the bottom of a body 12 of molten thermoplastics material thereon and the spinneret plate 11 presents an external face 13, which is exposed to the atmosphere and in the illustrated examples is arranged to be substantially horizontal, and an internal face 14 exposed to the body 12 and upon which the body 12 rests.

Figure 1:
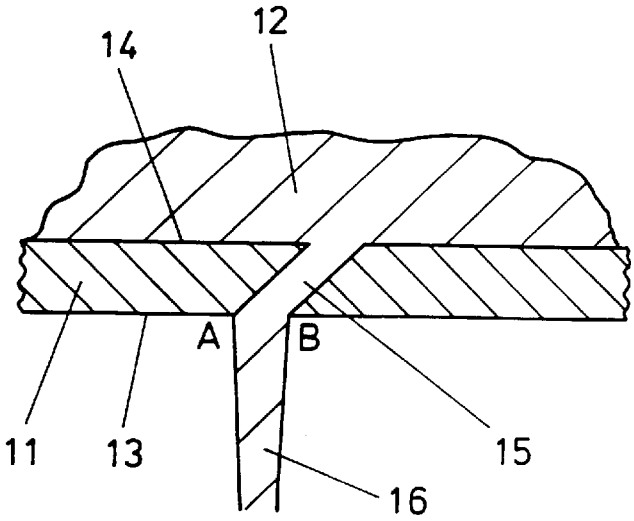
FIG. 1 shows, diagrammatically and in cross-section, one arrangement for spinning a filament in accordance with the invention.

In the example illustrated in FIG. 1 the spinneret plate 11, has a hole 15 formed therethrough and in the example the hole 15 is inclined at an angle of 45 degrees to the external face 13 of the spinneret plate 11.

A filament 16 of the thermoplastics material is drawn through the inclined hole 15 and is tensioned substantially at right angles to the plane of the surface 13 by the filament drawing arrangement (not shown).

Because the filament 16 is subjected to the rapid change of direction on leaving the hole 15, and due to the axial tension applied at an angle of 45 degrees to the axis of the filament formed in the hole 15, the filament 16 has differential stresses formed therein and which stresses cause the filament 16 to adopt a substantial degree of helical crimp when the filament 16 is allowed to relax.

Figure 2:
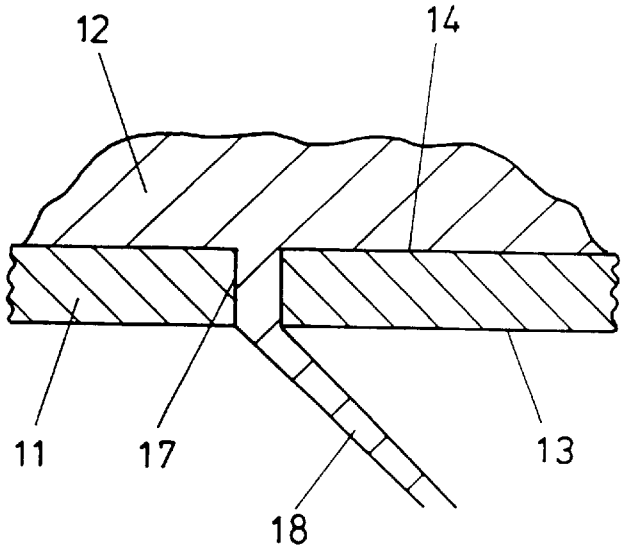
FIG. 2 shows, diagrammatically and in cross-section, a second arrangement for making a filament in accordance with the invention.

In the example illustrated in FIG. 2 a hole 17 through the spinneret plate is substantially at right angles to the plane of the surface 13 but in this example the filament 18 is drawn off at an angle of some 45 degrees to the plane of the surface 13. By this means turbulence in the plastics material forming the filament 18, and the differential stresses in the filament 18 in being turned to the line of draw of the filament 18, generates differential stresses in the filament 18.

Figure 3:
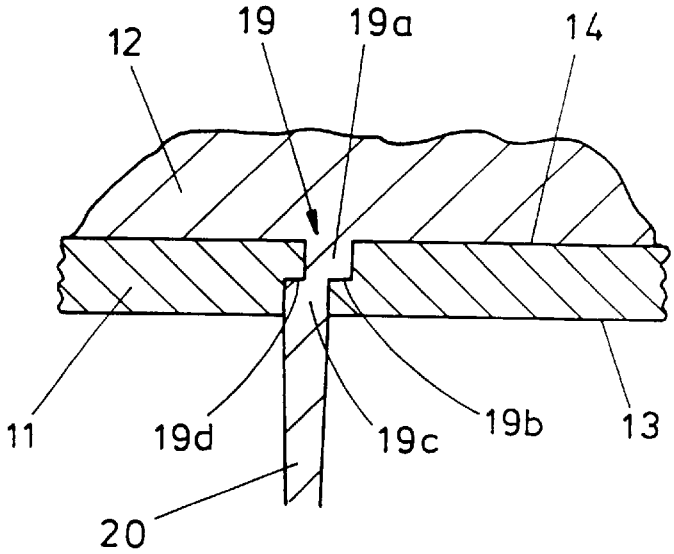
FIG. 3 shows, diagrammatically and in cross-section, a third arrangement for making a filament in accordance with the invention.

In the example illustrated in FIG. 3 a filament extruding hole 19 in the spinneret plate 11 is formed by two cylindrical holes formed in opposite faces of the spinneret plate 11, with their axes substantially parallel but one axis offset from the other axis, and with the holes overlapping to form the hole 19 passing through the spinneret plate. In this example the plastics material 12 flowing into the hole 19*a* and subsequently hole 19*c* is subjected to a great deal of turbulence, caused by the upwardly facing crescent shaped ledge 19*b* and the downwardly facing crescent shaped ledge 19*d* within the hole 19, and whilst the filament 20 is being formed.

Figure 4:
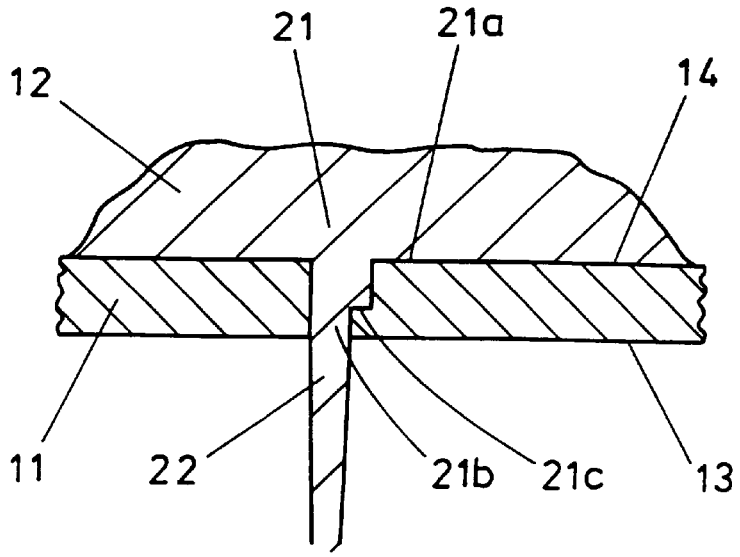
FIG. 4 shows, diagrammatically and in cross-section, a fourth arrangement for making a filament in accordance with the invention.

In the example illustrated in FIG. 4 a hole 21 through the spinnerette plate 11, and from which the filament 22 is extruded, is again formed in two parts, the part 21*a* in the surface 14 and the hole 21*b*, of smaller diameter which opens to the surface 13 of the spinnerette plate 11. In this example the hole 21*b* is fully exposed to the hole 21*a* but, being of smaller diameter, forms a crescent shaped ledge 21*c* between the holes 21*b* and 21*a*. Thus, in this embodiment, the thermoplastics material flowing to form the filament 22 is subjected to substantial turbulence as the filament 22 is formed.

Figure 5:
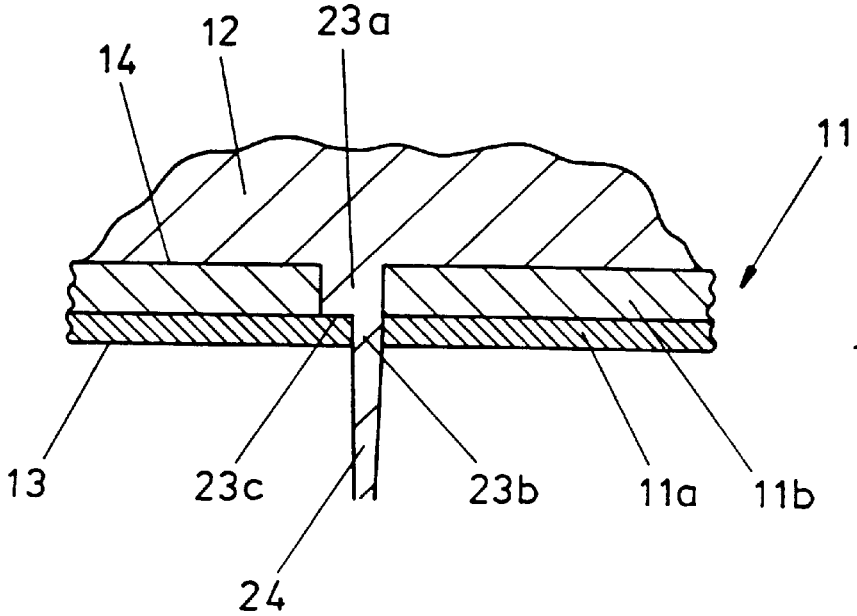
FIG. 5 shows, diagrammatically and in cross-section, a fifth arrangement for making a filament in accordance with the invention.

In the example illustrated in FIG. 5 there is disclosed one method by which the spinnerette plate 11 can be formed to have a filament extrusion hole 23 formed by two holes of different diameter. Thus, in this embodiment, the spinnerette plate 11 is formed by two elements, 11*a* and 11*b*, a first hole 23*a* is formed in the element 11*b*, a second hole 23*b* is formed in the element 11*a*, the hole 23*b* has a smaller diameter than the hole 23*a*, and the elements 11*a* and 11*b* are so assembled that the hole 23*b* is fully opened to the hole 23*a*. The hole 23*b*, being of smaller diameter than hole 23*a*, allows the element 11*a* to present a crescent shaped ledge 23*c* in the flow path through the hole 23. The ledge 23*c* generates substantial turbulence in the flowable plastics material immediately before, and during, formation of the filament 24.

It will be appreciated by persons skilled in the art that the method of assembly of the spinneret plate 11 illustrated in FIG. 5 could be used in the embodiments of FIGS. 3 and 4.

It is believed that the turbulence generated in the flowable plastics material immediately prior to, and whilst the said material is being brought to a condition where the filament is being formed, generates substantial shear across the width of the filament as the filament is formed and, when the axial tension of the drawing apparatus and subsequent processing apparatus is relieved the differential stresses across the width of the filament are at least partially relieved by the filament adopting a pronounced helical crimp.

Figure 6:
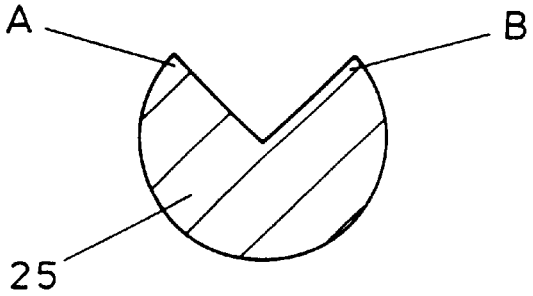
FIG. 6 shows a cross-section through one form of spinneret hole in accordance with the invention.

However, to increase the crimp effect the filaments 16, 18, 20, 22 and 24 may be formed in respective holes, 15, 17, 19, 21 and 23 to have a non-circular cross-section and FIG. 6 illustrates one cross-section, comprising a full-circular cross-section with one quarter of the circle removed, and when the filament is being extruded from the holes, 15, 17, 19, 21 and 23 the points A and B of the extrusion hole 25, illustrated in FIG. 6, may be disposed close to the points A and B as illustrated in FIG. 1. Further, the non-circular cross-section filaments 25 may be subjected to a rapid differential cooling, which will again increase the crimp formed in the filaments. FIG. 6 shows the cross-sectional area of a typical filament extrusion, or spinneret, hole 25.

It has been noted that polymers with a lower Melt Flow Index exhibit a greater tendency to produce self-crimping filaments. Furthermore, it has been shown that the lower the extrusion temperature and hence the higher the viscosity of the molten polymer, the greater is the shear and the greater the effect of self-crimping will be.

Whilst it has been shown in practice that this system of self-crimping is not dependent on asymmetric cooling such cooling when combined with the method of the embodiments described above can produce an enhanced crimp in the filaments. It has been observed during trials that the degree of crimp is dependent on the temperature and time delay between the polymer with turbulent flow emerging from a spinneret, to the time it solidifies and changes to the crystalline state.

When polypropylene changes from a molten state to the solid state, it does so in two stages. The polymer first of all passes through the "glass transition" stage. At this stage the polymer is amorphous. Stresses in the polymer in the glass transition state will self-anneal if maintained at the glass transition temperature, but at a much slower rate than in the molten state.

In the second stage, once the polymer has passed through the glass transition state, it begins to crystallise. When this occurs any molecular stresses in the polymer are locked into the crystalline structure. It is these irregular stresses which cause the fibres to distort i.e. self-crimp when they are drawn (orientated).

Further, whilst it has been observed by trials that the self-crimping effect by this method as described is not dependent simply on asymmetrical cooling the asymmetrical cooling is effective if it takes place at the correct point in the process. Thus a filament cooled by blowing air from more than one direction relative to the filament produces the same effect providing the filament solidifies to the crystalline state before the internal stresses are dissipated.

It has also been shown that the self-crimping effect can be achieved without the use of blowing air or gas onto the filaments. Contact with a cold surface i.e. a roller with a cold surface or non-rotating cylindrical cold surface or a flat cold surface produces the same effect providing always that the polymer is cooled to the crystalline state before the imparted stresses are dissipated.

The rate of cooling in a stream of gas (air) is not dependent on air temperature alone but also on the "wind chill" effect due to velocity. It is therefore possible to affect the degree of crimp in the final product by using quench air at variable velocity with constant temperature, or vice-versa, providing always the filament is cooled to the crystalline state before the internal stresses have dissipated.

It has been found that a preferred method of cooling the filaments is by subjecting the molten filaments emerging from the spinneret to a stream of "cold steam".

"Cold steam" can be produced by passing water into an ultra-sonic whistle energised by compressed air. The "cold steam" comprises minute particles of water which rapidly evaporate on contact with the filaments. The latent heat of vaporisation produces a very pronounced reduction in temperature.

This method of cooling is particularly advantageous because it only requires to have a flow of "cold steam" with minimal velocity so that the filaments are not vibrated or caused to flutter. This is a problem associated with using air at high velocity, and results in adjacent filaments touching and bonding together.

Understanding of the above embodiments will be further assisted by the following examples.

EXAMPLE 1

A spinneret plate was drilled with 3454 holes of cross-sectional shape as shown in FIG. 6, each hole having a diameter of 0.8 mm. The holes were drilled in a 1:1 staggered pattern of 22 rows×79 columns and 22 rows×78 columns in the spinneret plate.

The spinneret plate was fitted to a 65 mm extruder which was connected to a staple fibre extrusion line. The extruder was charged with a narrow molecular weight polypropylene polymer sold by the Shell Chemical Co under the grade no. PLZ987. The extruder and spinneret were heated electrically, a temperature gradient of 196° C. to 215° C. was set on the extruder, and the spinneret maintained at a temperature of 210° C. The spinneret and die head of the extruder were positioned so that the fibres were extruded horizontally.

On emerging from the spinneret, the freshly formed fibres were chilled by directing a blast of cooling air so as to freeze into the fibres the differential stress and turbulence built into them by the shape of the holes in the spinneret. The air temperature was maintained at 14° C. and to give additional cooling, the fibres were passed around ⅓ of the circumference of a non-rotating segmented cooling roller which was situated 110 mm from the spinneret face. The roller was of 180 mm diameter and was filled with circulating refrigerated water maintained at a temperature of 5° C. After passing around this refrigerated roller, the fibre tow passed through an air heated crystallisation oven and then to two sets of godet rollers of the staple fibre line.

The speed of the first godet rollers was adjusted to 25 meters per minute, and the second godet rollers to a speed of 75 meters per minute so that the fibre was subjected to a stretching ratio of 3:1. Between the two godet sets a hot plate stretching device was situated so that the polypropylene fibres were in contact with this plate during the drawing process. The plate was maintained at a temperature of 100° C., and the speed of the extruder was so adjusted that the throughput of polymer gave fibres, after the stretching step, which were 15 denier per filament (i.e. 9000 meters of a single fibre weighed 15 grammes).

From the last godet roller of the fast set of stretching rollers, the fibre tow was lubricated with spin finish oils and then passed to a drum cutter where the fibre tow was cut to staple of 100 mm length.

As soon as the tension was removed from the fibre tow by cutting to separate short lengths of staple, the fibres immediately formed into a tight helical crimp. Examination of the helical crimp showed that it was a permanent effect and could not be removed by tensioning the fibre.

A batch of fibre which had been made in the manner described above was placed in a heat setting oven for a period of three minutes. The oven was maintained at a temperature of 130° C., and the heat set fibre was then removed and again examined and compared to the non heat set fibres. The heat set fibres had shrunk in length by 10% and the helical crimp frequency had increased and the fibre was even more resilient.

EXAMPLE 2

Example 1 was repeated, but the drawing speed was increased to 95 meters per minute with a draw ratio of 3:1, and the extruder speed adjusted to produce drawn filaments with a denier of 12 denier. On allowing the fibre to relax free of tension, the fibres spontaneously formed into tight helical crimps. On heat setting, the fibre was even more resilient.

EXAMPLE 3

Example 2 was repeated with the exception that the output of the extruder was reduced so that the final denier of the fibre was 6 denier per filament. On allowing the fibre to relax free of tension, the fibres spontaneously formed into tight helical crimps. On heat setting, the fibre was even more resilient.

EXAMPLE 4

Example 1 was repeated with the exception that the spinneret was replaced by one drilled with the same number and layout of holes except that the hole cross-section was circular rather than as shown in FIG. 6. The holes were arranged in the normal manner as would be carried out by a person skilled in the art of extruding synthetic fibres. The circular cross-section would produce the minimum of turbulence in the polymer flow immediately prior to, or at the point of, formation of the filaments.

The fibre extrusion line and extruder were operated exactly in the manner of example 1 and 15 denier fibre was produced. When these fibres were cut into staple lengths of 100 mm and all tensions released, they did not crimp into a helical form but remained generally straight with only a slight undulation. The fibres remained unchanged even after heat setting and were not highly resilient.

EXAMPLE 5

Example 4 was repeated using the same spinneret as in example 4 with round holes, but with the exception that the fibres were deflected from a horizontal path by lowering the cooling contact roller so that the angle of the fibres was 45° from the horizontal. When these fibres were cut into 100 mm staple lengths, they formed into a helical crimp.

EXAMPLE 6

Example 1 was repeated with the exception that the spinneret was replaced with one having the same number of holes laid out in exactly the same pattern and of the same cross-sectional shape as shown in FIG. 6, but the holes were drilled at an angle of 45° to the horizontal as shown in FIG. 1. Fibres with a denier of 15, 12, 10, 8, 6, 5, 4 were prepared using the extrusion conditions and godet speeds as previously described.

In each case, the fibres were prepared using this angle of drilling of 45° had a higher degree of helical crimp when compared to the same cross-sectional shape of fibre but where the holes in the spinneret were drilled at 90°.

It will be appreciated by persons skilled in the art that the above embodiments and examples have been described by way of example only and not in any limitative sense, and that various alterations and modifications are possible without departure from the scope of the invention as defined by the appended claims.

What is claimed is:

1. A method for producing a continuous filament by extrusion of molten thermoplastic material through a spinneret plate having holes of a cross-sectional configuration that is determinative of the cross-section of the formed filament, the method comprising the steps of generating a turbulence in the molten thermoplastic material intended to form the filament, immediately prior to, or at the point of, formation of the filament, whilst the thermoplastics material is in its glass transition phase and maintaining stresses induced in the formed filament by said turbulence whilst the filament material passes into its crystallised phase; and forming filaments having a substantial helical crimp by extruding the molten thermoplastic material through holes in the spinneret plate.

2. The method according to claim 1 wherein the filaments have a predetermined cross-section and the induced turbulence is concentrated towards one side of the cross-section of the filaments.

3. The method according to claim 1 further comprising the step of rapidly cooling the molten filaments to solidification.

4. The method according to claim 1 wherein the step of forming comprises extruding the filaments through holes in a spinneret plate wherein each hole makes an angle to an external face of the spinneret plate.

5. The method according to claim 4 wherein each hole makes an angle of substantially 45 degrees to the external face of the spinneret plate.

6. The method according to claim 1 wherein the turbulence in the molten thermoplastic material is generated by a change in the cross-sectional area of each hole through the spinneret plate.

7. The method according to claim 6 wherein the change of cross-sectional area of each hole through the spinneret plate is in the form of a step.

8. The method according to claim 1 wherein each formed filament has a non-circular cross-section.

9. The method according to claim 8 wherein each spinneret hole has a cross-sectional configuration which is generally equivalent to a full circular cross-section with substantially one quarter of the circle removed.

10. The method according to claim 3 wherein the filaments are cooled immediately after extrusion through the spinneret plate and subsequently passed through a crystallisation oven.

11. A spinneret for use in thermoplastic material extrusion, said spinneret having a spinneret plate that is provided with a plurality of holes characterized in that said holes generate a turbulence in the thermoplastic material while in its glass transition phase as it is extruded through said spinneret.

12. The spinneret according to claim 11 wherein the holes are of non-circular cross section.

13. The spinneret according to claim 12 wherein the holes have a cross-sectional shape which is generally equivalent to a full circular cross section with substantially one quarter of the circle removed.

14. The spinneret of claim 11 wherein the cross-sectional area of each hole through the spinneret plate is in the form of a step.

15. The method according to claim 1 wherein the step of forming comprises extruding the filaments through holes in a spinneret plate by drawing the formed filament at an angle to the plane of the spinneret plate.

16. The method according to claim 15 wherein the angle is substantially 45 degrees.

17. A method for producing a continuous filament by extrusion of molten thermoplastic material through a spinneret plate having holes of a cross-sectional configuration that is determinative of the cross-section of the formed filament, the method comprising the steps of generating a turbulence in the molten thermoplastic material whilst the thermoplastics material is in its glass transition phase and maintaining stresses induced in the formed filament by said turbulence whilst the filament material passes into its crystallised phase; and forming filaments having a substantial helical crimp by extruding the molten thermoplastic material through holes in a spinneret plate wherein each hole makes an angle to an external face of the spinneret plate.

18. The method according to claim 17 wherein each hole makes an angle of substantially 45 degrees to the external face of the spinneret plate.

19. A method for producing a continuous filament by extrusion of molten thermoplastic material through a spinneret plate having holes of a cross-sectional configuration that is determinative of the cross-section of the formed filament, the method comprising the steps of generating a turbulence in molten thermoplastic material intended to form the filament, whilst the thermoplastic material is in its glass transition phase and maintaining stresses induced in the formed filament by said turbulence whilst the filament material passes into its crystallised phase; and forming filaments by extruding the molten thermoplastic material through the spinneret plate wherein the turbulence in the molten thermoplastic material is generated by a change in the cross-sectional area of each hole through the spinneret plate.

20. The method according to claim 19 wherein the change of cross-sectional area of each hole through the spinneret plate is in the form of a step.

21. A spinneret for use in thermoplastic material extrusion, said spinneret having a plate that is provided with a plurality of holes characterized in that the cross-sectional area of each of said holes through the spinneret plate has a cross-sectional area through the plate that is in the form of a step so as to generate a turbulence in the thermoplastic material while in its glass transition phase as it is extruded through said spinneret.

* * * * *